United States Patent [19]

Fernandes

[11] 4,169,723

[45] Oct. 2, 1979

[54] PROCESS OF MELTING BLAST-FURNACE CAST-IRON

[75] Inventor: Roberto Fernandes, Itauna, Brazil

[73] Assignee: Siderugica Italia S.A., Brazil

[21] Appl. No.: 500,380

[22] Filed: Aug. 26, 1974

Related U.S. Application Data

[63] Continuation of Ser. No. 259,494, Jun. 5, 1972, abandoned.

[51] Int. Cl.[2] ..... C21B 5/00

[52] U.S. Cl. ..... 75/41; 75/24; 75/46

[58] Field of Search ..... 266/37, 38, 40, 42; 75/41, 42, 24, 46

[56] References Cited

U.S. PATENT DOCUMENTS

| | | | |
|---|---|---|---|
| 3,549,141 | 12/1970 | Zimmermann | 266/42 |
| 3,589,699 | 6/1971 | Bogar | 266/37 X |
| 3,626,072 | 12/1971 | Haralampier | 75/10 UX |

FOREIGN PATENT DOCUMENTS

| | | | |
|---|---|---|---|
| 1013838 | 5/1952 | France | 75/43 |

*Primary Examiner*—M. J. Andrews

*Attorney, Agent, or Firm*—Robert E. Burns; Emmanuel J. Lobato; Bruce L. Adams

[57] ABSTRACT

A method and apparatus for the continuous pouring of pig-iron from blast furnaces is described. The method is based upon the provision of a reservoir external to the furnace and spaced therefrom but connected thereto by a passageway. The reservoir of molten metal permits the storage of an amount of molten metal at a level equal to or equilibrated to the level of molten metal within the furnace resulting from the hydrostatic head of liquid produced by the molten metal within the hearth, the slag resting upon the molten metal and the solid overburden of ore within the blast furnace. The reservoir permits the continuous pouring of molten metal from the furnace by adjustment of a pouring opening thereof to a level of the reservoir equal to the level of molten metal within the furnace. Semi-continuous operation is obtained by adjusting the level of the pouring opening to levels above the level of the liquid metal within the furnace. The volume provided for the reservoir should be ample to contain the liquid metal during periods when the pouring is discontinued. When the pouring is a continuous operation the volume of the reservoir may be limited to the volume of the passage connecting the reservoir with the blast furnace.

9 Claims, 4 Drawing Figures

PROCESS OF MELTING BLAST-FURNACE CAST-IRON

This is a continuation, of application Ser. No. 259,494, filed June 5, 1972, now abandoned.

FIELD OF THE INVENTION

This invention refers to blast furnaces and more particularly to blast furnaces designed for continuous operation wherein the liquid metal is accumulated within a reservoir from whence it is poured into ladles or ingots.

BACKGROUND OF THE INVENTION

In the traditional system of cast-iron melting, the cast-iron is accumulated, in liquid form, in a blast-furnace hearth or crucible, and poured, at regular intervals, into ladles, casting machines, ingot forming machines, or sand molds. The quantity of cast-iron accumulated, being the maximum contained in the volume related to the diameter of the crucible and to the height of the tapping opening for the slag.

The traditional system, has the following major shortcomings:

(a) The crucible is too quickly emptied, causing a faster than the normal drop of the liquid column in the blast-furnace and consequently provoking variations in the blowing pressure, and the volume of injected air, as well as in the normal conditions of heat transfer and the chemical and physio-chemical balance between the solid, liquid and gaseous materials existing in the internal portions of the blast-furnace.

(b) Casting of the accumulated cast-iron is usually made six times in every twenty four hours. The opening of the metal pouring orifice (tapping hole) by means of a compressed air hammer, oxygen torch, chisel and/or hammer, constitues one of the more serious safety problems of the blast-furnace practice, especially in small size plants, where the cast-iron is poured directly into the sand molds, casting ladles or casting machine forms, without using intermediate pans. Furthermore, the regulation of the pouring of the liquid cast-iron, during the pouring operation, which regulation is an essential factor for obtaining a quiet and even filling of the sand molds or the forms, is practically unobtainable, and a violent flow of liquid cast-iron, when no pans are available for the storage of the liquid cast-iron, causes the irregular or improper filling of the molds with the consequent formation of large percent of scrap pig iron. It also causes bubbling and spraying of liquid metal over great distances, which is extremely dangerous and causes large losses. Added to this is the formation of large quantities of scrap iron during the pouring leakage, which constitutes a very serious economic factor, as this scrap when sold commands a much lower price than common pig iron.

(c) After the pouring of the pig iron from the blast-furnace, another serious problem is the need for adequately and promptly blocking the pouring holes of the furnace. In the large mills, such capping or blocking accomplished by expensive clay-ramming machines and associated equipment: in medium size and small mills, the work is done manually, exposing the workers to excessive heat and great risk of burns.

In any case, the opening, the closing and the maintenance of the pouring holes for the pig iron constitute major problems to the operators of blast-furnaces. Another major problem results from the damage caused by erosion of the pouring holes, and the adjacent refractory bricks. The furnace tapping beyond regular hours, also constitutes an equally serious problem in the operation of blast-furnaces.

(d) During the conventional, intermittent pouring of the melted pig iron, the level of the liquid pig iron in the blast-furnace crucible varies considerably during the time between two successive pourings; the same variation also occurring in the layer of slag which floats on the pig iron in the crucible. For that reason, the quantity of pig iron and slag accumulated in the crucible varies from minimum value (immediately after pouring) to a maximum value (immediately before the pouring of the pig iron or the slag). The increase in the level of these liquid layers accumulated in the crucible results, as a first consequence in a gradual increase in the blowing pressure of the blast-furnace. Such increase, if the mill does not possess constant pressure blowing equipment, diminishes the volume of air injected by the blowers, and consequently diminishes the rate of settling of the solid masses, and thereby causes a drop of the hourly production rate of the blast-furnace.

An excessive increase of the height of the level of slag in the crucible, may cause the slag to come in contact with the tuyeres, damaging or obstructing them. If the level of the smelted pig iron should reach the tuveres for the blowers, there is also the grave danger of explosion.

Since the refinement of the chemical composition of the pig iron takes place in the crucible, by the reaction of the pig-iron and slag and by the passing of the liquid pig iron through the layer of the slag, it is noted that the relative quantities (masses) of the pig iron and slag present have a great influence on the final chemical composition of the pig iron.

If, during the conventional process, the quantity of slag which floats on the pig iron varies from zero to the maximum value permitted, it is evident that the reaction of the pig iron with the slag, especially during the passing of the drops of pig iron through the slag, varies in efficiency during the interval between two successive pourings. This causes variations in the chemical qualities of pig iron accumulated in the crucible where it is separated by order of the density. The pig iron with lower silicon content tends to segregate at the bottom of the crucible.

In other words, during the same pouring of the smelted pig iron considerable variation in chemical analysis is obtained based on density segregation. This segregation of the pig iron in the crucible is compounded by the fact that there is practically no motion in the liquid mass, it being subjected to practically no agitation.

SUMMARY OF THE INVENTION

The object of the present invention is the complete elimination of the aforesaid inconveniences yet providing a high yield level not found in any of the existing processes.

According to the improved process in this case, a flow of liquid pig iron is created, from the crucible of the blast furnace into an external reservoir separated from the blast furnace where the liquid pig iron accumulates prior to pouring into molds. This flow into the reservoir may be continuous or intermittent, according to the variations of the blower pressure of the blast furnace, the height of the layer of slag, and the height of the pig iron in the external reservoir.

The apparatus aspects of this invention include a continuous blast furnace comprising a blast furnace hearth in crucible form and a liquid metal reservoir, external to the wall of said furnace, and connected thereto by a passage through said wall of the furnace at a level above the hearth but below the upper level of liquid metal in the crucible. The reservoir is provided with a pouring opening at a level equal to the hydrostatic head of the molten metal within the furnace. The reservoir may be provided with a roofed enclosure and/or a heating source. Preferably the passage between the hearth and the reservoir is unobstructed during the operation of the furnace to provide for continuous passage of liquid metal from the hearth to said reservoir.

The process aspects of this invention for the pouring of molten pig-iron from a blast furnace comprises leading the molten pig-iron from the hearth of the blast furnace into a external reservoir independent from the hearth for molten pig-iron via an enclosed passage located at a level at or above the hearth level, but below the level of liquid metal in the furnace and pouring the liquid metal from an opening located at or below the level of liquid metal in said reservoir resulting from the hydrostatic head of the liquid metal within the furnace. Preferably the pouring is continuous. This is achieved by adjusting the level of the pouring opening to the level of the hydrostatic head within the furnace. The pouring may be discontinued by raising the level of the orifice above the level of the hydrostatic head of the liquid-metal and slag within the furnace.

BRIEF DESCRIPTION OF THE DRAWINGS

The attached drawing illustrates the present invention, in which.

DESCRIPTION OF THE PREFERRED EMBODIMENTS

In the above mentioned Drawing, a crucible 1 of the blast furnace is illustrated, with refractory walls 10, and provided with blowers (tuyeres) 2, as well as a slag hole 3, and could be constructed with holes 4 for emergency drainage.

Figure 1:
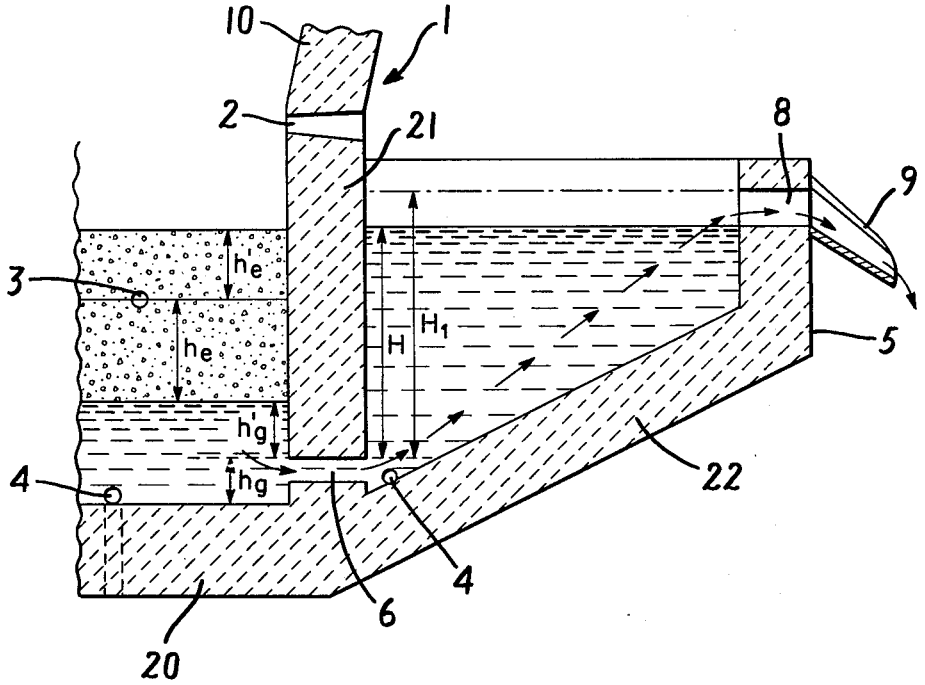
FIG. 1 shows in vertical section, a crucible of a blast furnace, equipped according to the invention with a external reservoir, without additional heating.
Figure 2:
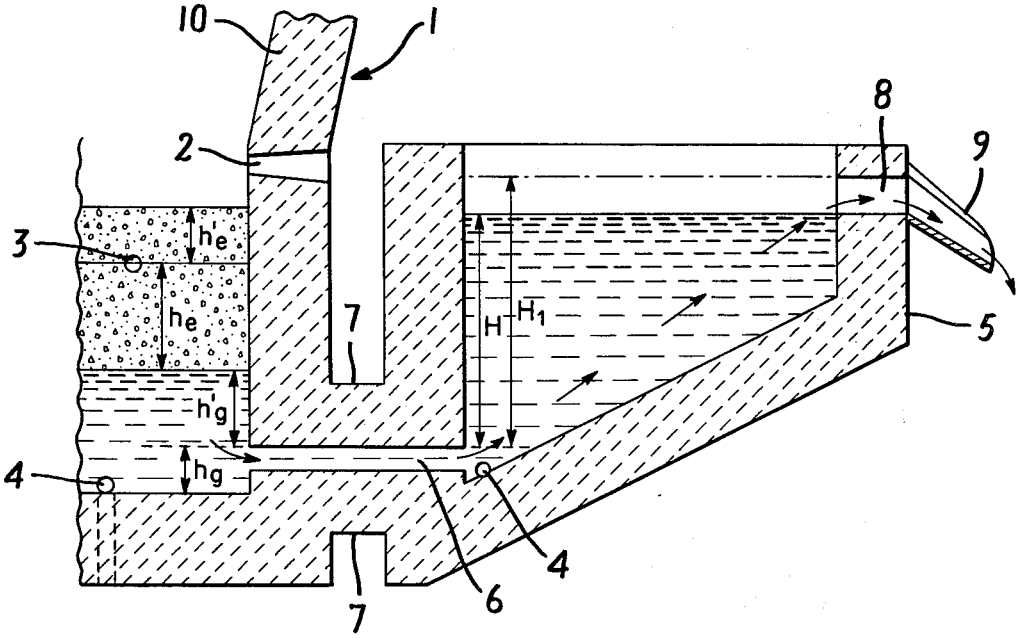
FIG. 2 illustrates, in vertical section, a crucible of a blast furnace, equipped according to the invention with a separate external reservoir, and also without additional heating.

Regarding the improvement in the process of pouring the pig iron from the blast furnace, the object of the present invention, it is based on the construction of an external reservoir 5 for liquid pig iron, combined with (FIGS. 1 and 3); or separated from (FIGS. 2 and 4); the refractory wall 10, of the crucible 1 of the blast furnace, and communicating with the internal part of the crucible 1 through a lower passage 6, which may be horizontal or inclined. The opening of the passage 6 connects the external reservoir 5 with the crucible 1, and has preferably the same dimensions as the prior art tapping holes, but remains always unobstructed, in order to establish constant communication between the crucible and the reservoir.

Initially, the external reservoir 5 may be constructed combined with the refractory wall 10 of the crucible, but it has been found that the common wall 11, remaining in a bath of pig iron on its two sides, experiences considerable erosion. To remedy this, external reservoir 5 has also been constructed separated from the crucible 1 (FIGS. 2 and 4) and communicating with it through an enclosed channel 7, at the location of the passage 6 from the crucible 1 of the blast furnace to the reservoir 5. This modification permits cooling of the external surfaces of the channel 7, thus enabling a greater durability of the refractory materials and is the preferred embodiment.

With respect to the external reservoir 5, whose walls and bottom 12 should be of refractory bricks, the shape as well as its volume do not have any influence on the functioning principle. However, for operational facility, having in mind the possiblity of inserting a steel bar in the communication passage 6 between the reservoir 5 and the crucible 1, in case of an obstruction of passage 6, it is convenient that the external reservoir 5 be elongated, for example rectangular and the bottom inclined. The side walls may also be inclined to facilitate removal of obstructions and for cleaning. With regard to the volume and corresponding capacity of the reservoir 5 for storing the liquid pig iron, the volume should be adequate to prevent the cooling of the liquid pig iron in it.

For continuous or nearly continuous pouring of the pig iron from the external reservoir 5 to an ingot machine, ladle, mold or other receptacle, it is not necessary that the reservoir have large capacity, however, for intermittent pouring it is convenient that the reservoir 5 should have a larger capacity, approximately the capacity of the crucible 1 of the blast furnace.

The external reservoir 5 may be provided with one or more drain openings to a canal 8 for the pouring of the pig iron from the spout or trough 9 into ingot machines or other receptacles (not shown). The opening 8 has a height that is easily regulated, and is provided with a directional trough 9, for directing the flow of pig-iron to the ingot machine or receptacle.

An operating principle of the improved process of this invention is to maintain a layer of liquid pig-iron in crucible 1 of the blast furnace, always above the level of the passage 6 communicating with reservoir 5, in this way preventing the flow of slag to the reservoir. In this manner it is possible to maintain in the external reservoir 5, a height of liquid pig-iron where the static pressure is equal to or equilibrated the pressure of the layer of liquid pig-iron in the crucible 1, including the pressure of the layer of slag which floats on the pig iron, and the pneumatic pressure from the blower of the air injected via the tuyeres 2.

In this way, the level of the pig-iron in the crucible 1, varies only with the blower pressure, with the pressure of the layer of the liquid slag and with the variation of the height of the pig iron in the external reservoir 5. Variations of the blower pressure, during the operation of the blast furnace, or by accident, can be compensated by varying the height of the pig iron in the reservoir.

The variation of the pressure caused by the slag, is gradual between successive pourings of the slag and is also slight. In case of continuous draining of the slag, the variation of the pressure from the slag is practically nil.

In this way, when calculating the height of the pig iron in the reservoir 5, the mentioned variation of the pressure of the slag should be taken into consideration, leaving a margin of safety, so that the slag level never reaches the opening of passage 6 from the crucible 1 to the reservoir 5.

Adjustment in the height of the liquid pig iron in the reservoir 5, may be easily effected by increasing or lowering the opening of drain canal 8 to trough 9. By constructing the opening to this canal with particulate refractory materials, the lowering or raising of the level can be easily adjusted by removing or adding material to the opening to by draining the canal and removing the dam therein.

This gradual lowering or raising of the level of canal 8 of the external reservoir 5 is very important, especially if the pig iron blow is to be varied intermittently. In this case, the level of the pig iron in the reservoir will vary from a minimum height H to a maximum height $H_1$.

For continuous pouring of pig iron from the reservoir, the level of same in the crucible of the blast furnace is practically constant, and for intermittent pourings, the level in the crucible varies from a value equal to $H_1$-H.

In all the illustrated examples of the attached drawing (FIGS. 1 and 5) directed to the pouring of pig iron from the reservoir 5 by the continuous process, and/or the intermittent process, the height of the liquid pig iron in reservoir 5 can be calculated in the following manner:

H—Height being of the liquid pig iron in the reservoir (in meters);

$H_1$—Maximum height of the liquid pig iron in the reservoir;

$d_g$—Specific weight of the liquid pig iron (in $K_g/dm^3$);

$d_e$—Specific weight of the liquid slag (in $K_g/dm^3$);

$h_g$—Height of the liquid pig iron in the crucible up to the higher level of the opening of passage 6—(in meters);

$h'_g$—Height of the liquid pig iron in the crucible —above passage 6 opening (in meters);

$h_e$—Height of the slag layer up to the hole 3 for the tapping the slag (in meters);

h'e—Maximum height of the slag, above the hole 3 of the draining the slag (in meters);

P—Blower pressure in meters of the water column,

Determine the value of H by the following equations:

$$H=(P+h'_g d_g+d_e(h_e+h'_e)/d_g$$

The value of $h'_g$ should be in the order of 0.20–0.30m, for small blast furnaces, and 0.40–0.60m or more, for large blast furnaces. This allows adequate safety margins against internal overpressures in the liquid pig iron layer of the crucible. Such overpressure could result from the solid ore column of the blast furnace or any other cause.

For the intermittent pouring of pig iron from the reservoir, the value of H increases in the interval between two successive pourings, up to a maximum value of $H_1$. The increase of the height $(H-H_1)$ of the level of the pig iron of the reservoir creates an equal increase in the height of $h'_g$ of the pig iron in the crucible and a corresponding lowering in the height $h_e$ of the slag.

For the semi-continuous pourings of pig iron from the reservoir 5, which happens when the pourings of the slag are intermittent, or when the blower pressure varies, the variation of H is very slight, and the time interval during which the pig iron stops flowing from the pouring orifice 8 of the reservoir is also slight (from 20 to 40 minutes for the smaller blast furnaces, with an interval of three hours for the slag draining from slap tap hole 3.

For continuous pourings, the value of H remains constant, the height $h'_e$ being practically non-existent, since the slag drains uninterruptedly from slag hole 3, and the blower pressure remains current. Continuous pouring of the pig iron from the reservoir can also be obtained, with intermittent pourings of slag, by lowering the value of H gradually, in accordance with the flow of slag, as $h'_e$ diminishes. To obtain the same result, the blower pressure can be gradually increased, as $h'_e$ diminishes. The application of both methods simultaneously is also possible.

Figure 3:
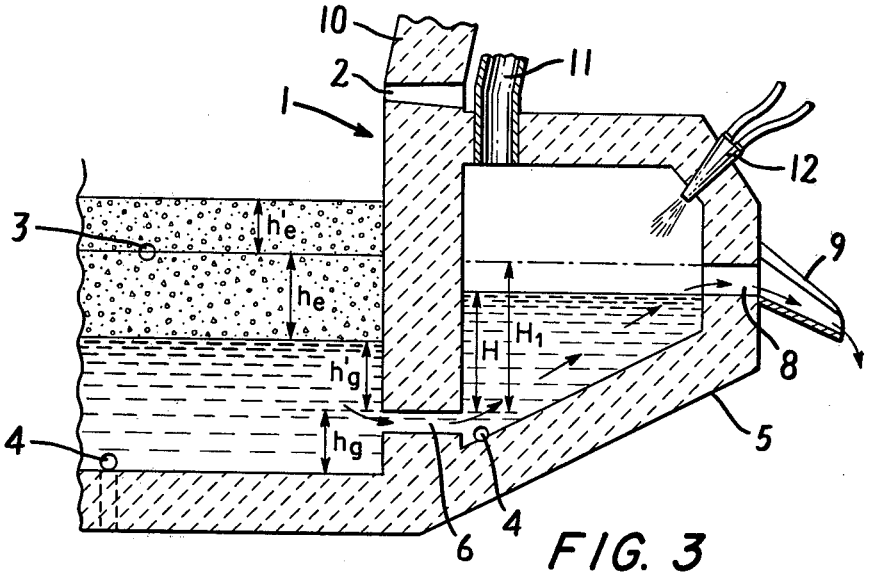
FIG. 3 shows, in vertical section, a crucible of a blast furnace, with an external reservoir, and with additional heating.
Figure 4:
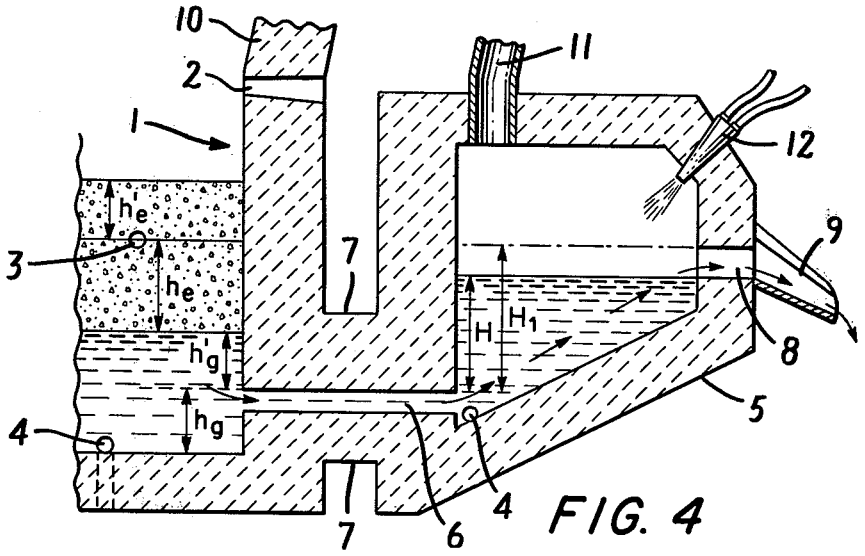
FIG. 4 illustrates, also in vertical section, a crucible of a blast furnace according to the invention with a separated external reservoir, and with additional heating.

Now, with reference to the FIGS. 3 and 4, the installation on the external reservoir 5, of a covering (roof) 10 which may be rigid or removable, and is provided with a chimney 11, and heating means, torch 12, burning convenient combustible fuel (liquid, gaseous, pulverized or mixed) permits among other things:

(a) maintaining or increasing the temperature of the pig iron of the reservoir for operational necessity, or for future utilization;

(b) maintaining principally in the case of intermittent pourings a layer of slag of convenient chemical composition over the pig iron in the reservoir 5, for the further purification of the pig iron, for example, desulphuration;

(c) making additions, metal or non-metal, for the purpose of preparing special pig irons of desired chemical compositions (special, alloy and other).

The type of refractory coating 20, 21, 22 of the external reservoir will be determined by the service required (the placing of the slag over the pig iron, chemical additions and others) and may be of an acid, basic or neutral type.

Finally, the improved process in question, results in a series of advantages over the conventional, among which the following may be specifically mentioned:

Extreme operational facility, without subjecting the workers to an excessively hot atmosphere, and dangerous spraying of liquid pig iron;

Elimination of all tapping equipment for the removal of obstructions of the flow holes (compressed air hammers and others) and subsequent plugging equipment such as furnace capping machines, since the communication passage 6 from the crucible 1 to the external reservoir 5 is always unobstructed, except by accidental obstruction or by will of the operator: in the last instance, the obstruction is made with clay bung, provided the external reservoir as well as the crucible are empty. Any obstruction may be removed by the use of steel rods inserted through hole 4 at the external end of passage 6;

Elimination of the problems of damage to the mouth of the flow outlet and the refractory coating in its immediate vicinity;

Permits the alternate methods of operation including continuous pouring, semi-continuous pouring or intermittent pouring of the pig iron from the external reservoir with the almost complete elimination of scrap from the usual troughes used ingot preparation;

Permits regulating the blower pressure (in the continuous pouring or semi-continuous pouring) with the consequent uniform descent of the solid ore cargo within the blast furnace;

Almost total elimination of the dangers of damage and obstruction of the tuyeres from contact with the pig iron or slag, since the layers of pig iron and slag in the crucible can be maintained much lower than in the conventional process;

Creates conditions for the manufacture of homogeneous pig iron. The homogeneity is helped by the possibility of maintaining within the crucible a constant layer of slag of great height, facilitating in this manner, a complete pig iron slag refining reaction, when the pig iron droplets pass through a thick layer of slag. The physical motion of the pig iron bath into the reservoir also tends to provide uniformity. This motion is evident, since there exists an almost continuous flow of pig iron from the crucible to the reservoir;

Obtaining physically hotter pig iron by the use of the torch 12 in the reservoir;

Obtaining special pig iron or pig iron alloys, by additions made in the external reservoir;

Obtainable more homogeneous pig iron by means of agitation in the reservoir. This agitation can be produced, among other ways, by means of a steel bar or a refractory insulated agitating means immersed in the bath;

Increasing the production of the blast furnaces from 10% to 20%, by creating conditions which allow for regularity of production and planning procedures not obtainable in conventional pig iron processing.

To reiterate, this invention provides an improvement in the process of pouring of pig iron from blast furnaces, based on the continuous or intermittent pouring, of the liquid from an external reservoir directly joined to the crucible of the blast furnace. The external reservoir may be combined or separated from the refractory wall of the crucible of the blast furnace, may be provided with a fixed or removable roof with additional heating, and with emergency holes. The refractory insulation of the reservoir can be acid, basic or neutral. The communication of the external reservoir with the crucible is via a passage, that is always unobstructed. Moreover, in this process, an equal pressure is created between the pig iron of the reservoir and the pressures of the liquid pig iron in the crucible, plus the pressure of the blower of the blast furnace. Besides the additional over pressures on the pig iron of the crucible, arising from the solid cargo of the blast furnace, maintains within the crucible a layer of liquid pig iron, so that its level always remains above the opening of communication passage with reservoir, in this way preventing the flow of slag to the reservoir.

What is claimed is:

1. A process for separating molten metal from blast furnace slag comprising, flowing molten metal without slag from the hearth of a blast furnace into an external reservoir for molten metal via an enclosed passage located at a level below the upper level of the molten metal in the furnace, equilibrating the level of molten metal in said reservoir with the head pressure of the molten metal and slag above the upper level of said enclosed passage and a selected substantially constant air pressure in said blast furnace, and while simultaneously replenishing the molten metal in said reservoir by flowing thereinto metal through said passage, pouring slag-free molten metal from said reservoir through a channel opening from said reservoir at approximately the level of said molten metal in said reservoir and at a rate of replenishing and pouring determined at least in part by varying the air pressure in said furnace, whereby said pouring is controllable to pour continuously or intermittently determined by the extent of time said variation of said air pressure is maintained in said blast furnace, and cooling an area around said passageway to reduce erosion by said molten metal.

2. A process for separating molten metal from slag in a blast furnace comprising, flowing molten metal from the hearth of a blast furnace to an external reservoir separated from the blast furnace and separated therefrom via an enclosed passageway located at a level below the upper level of liquid metal in the hearth of the blast furnace and continuously open providing continuous communication between the molten metal in the furnace and the reservoir, for flowing therethrough slag-free molten metal continuously from said blast furnace to said reservoir, continuously equilibrating through said passageway a level of a volume of slag-free molten metal at atmospheric pressure in said reservoir to a head pressure in said blast furnace determined by molten metal in the hearth above the level of said passageway, slag on the molten metal in said hearth and an air pressure applied in said blast furnace over said slag to determine an upper level of the molten metal in the reservoir variable in response to variations of the head pressure in said blast furnace, continuously cooling around the enclosed passageway, and and varying the head pressure in said blast furnace by varying the air pressure applied to said blast furnace to intermittently or continuously flow slag-free molten metal out of said reservoir along a channel path disposed above or below the upper level of the molten metal in said reservoir as a function of the extent of the variation of the air pressure and the length of time the air pressure is varied.

3. A process for separating molten metal from slag in a blast furnace comprising, flowing a volume of slag-free molten metal along a first path from below the upper level of molten metal in a blast furnace to externally of the blast furnace, containing this volume of slag-free molten metal externally of the blast furnace while equilibrating the level of the volume of molten metal with a head pressure of the molten metal and slag thereon in the blast furnace above the upper level of said first path and a substantially constant air pressure over said slag in said blast furnace, and pouring slag-free molten metal from said external volume along a path in communication with said external volume of molten metal at approximately the equilibrated level by varying the air pressure in said blast furnace while simultaneously replenishing the molten metal in said external volume with molten metal from said blast furnace, whereby said pouring is continuous or intermittent in dependence upon the extent of time of said variation of air pressure and the rate of pouring is determined by the level of said path relative to said equilibrated level of said volume and the value of the variation of said pressure in said blast furnace, and continuously cooling said first path externally to reduce erosion thereof by the molten metal.

4. A process for separating molten metal from slag in a blast furnace according to claim 3, in which the level of communication of said path with said external volume is below the equilibrated level, and said path is damable with removable material removed to open said path to maintain said molten metal pouring continuously.

5. A process for separating molten metal from slag in a blast furnace according to claim 3, in which the level of the communication of said path with said external volume of molten metal is above said equilibrated level.

6. A process for separating molten metal from slag in a blast furnace according to claim 5, in which said level of the communication of said path with said external volume of molten metal is lowerable to a level below said equilibrated level.

7. A process for separating metal from slag in a blast furnace comprising, flowing a volume of slag-free molten metal from below the upper level of molten metal in a blast furnace to externally of the blast furnace along an enclosed passageway, containing said volume of slag-free molten metal at an atmospheric pressure externally of the blast furnace and spaced therefrom while equilibrating a level of the external volume of molten metal to a head pressure of the molten metal and slag thereon in the blast furnace and an air pressure over said slag in said blast furnace thereby to establish an upper level of the molten metal of said external volume, flowing slag-free molten metal from said external volume along a second path continuously in communication with said external volume of molten metal by increasing the air pressure in said blast furnace to vary the height of the upper level of said external volume and simultaneously replenishing molten metal in said external volume with molten metal from said blast furnace, and continuously forcibly cooling said enclosed passageway.

8. A method of operating a blast furnace having a refractory-lined reservoir separated and spaced from the hearth of the blast furnace and an enclosed passageway located at a level below the upper level of liquid molten metal in the hearth of the blast furnace in operation and providing continuous communication between the hearth of the blast furnace and the reservoir, said method comprising; continuously flowing molten metal from below the upper level of molten metal in the hearth of the blast furnace into said reservoir while continuously equilibrating through said passageway a level of a volume of slag-free molten metal at atmospheric pressure in said reservoir to a head pressure in said blast furnace corresponding to a head of molten metal in said hearth above the level of said passageway, slag on the molten metal in said hearth and an air pressure applied over said slag to determine an upper level of the molten metal in the reservoir variable in response to variations of the head pressure in said blast furnace, pouring a slag-free molten metal from said reservoir through an opening therein by varying the air pressure applied to said blast furnace to vary the upper level of said volume of molten metal in said reservoir relative to said opening, whereby the continuous or intermittent pouring is controlled by variation of said air pressure and as a function of the extent of variation of the air pressure and the length of time of the air pressure variation and forcibly cooling said enclosed passageway.

9. A process for separating molten metal from blast furnace slag comprising, flowing molten metal without slag from the hearth of a blast furnace into an external reservoir for molten metal via an enclosed passage located at a level below the upper level of the molten metal in said reservoir with the head pressure of the molten metal and slag above the upper level of said enclosed passage and a selected substantially constant air pressure in said blast furnace, and while simultaneously replenishing the molten metal in said reservoir by flowing thereinto metal through said passage, pouring slag-fee molten metal from said reservoir through a channel opening from said reservoir at approximately the level of said molten metal in said reservoir and at a rate of replenishing and pouring determined at least in part by varying the level of said channel opening, whereby said pouring is controllable to pour continuously or intermittently determined by the extent of time said variation of said level of said channel opening is maintained in said reservoir and forcibly cooling said enclosed passageway.

* * * * *

UNITED STATES PATENT AND TRADEMARK OFFICE

CERTIFICATE OF CORRECTION

PATENT NO. : 4,169,723

DATED : 2 October 1979

INVENTOR(S) : ROBERTO FERNANDES

It is certified that error appears in the above-identified patent and that said Letters Patent are hereby corrected as shown below:

The name of the assignee is incorrectly spelled and should read:

SIDERURGICA ITATIAIA S/A,
Brazil

Signed and Sealed this
*Third* Day of *February 1981*

[SEAL]

*Attest:*

RENE D. TEGTMEYER

*Attesting Officer* *Acting Commissioner of Patents and Trademarks*